United States Patent [19]

Tabaru et al.

[11] Patent Number: 4,554,232

[45] Date of Patent: Nov. 19, 1985

[54] MAGNETIC TONER

[76] Inventors: Kazunori Tabaru; Takafumi Aoyama; Toshio Kumakura, all of c/o Hitachi Metals, Ltd., 1-2, 2-chome, Marunouchi, Chiyoda-Ku, Tokyo, Japan

[21] Appl. No.: 190,035

[22] Filed: Sep. 23, 1980

Related U.S. Application Data

[63] Continuation of Ser. No. 944,353, Sep. 21, 1978, abandoned.

[30] Foreign Application Priority Data

Sep. 22, 1977 [JP] Japan ..... 52-113337
Sep. 22, 1977 [JP] Japan ..... 52-113338

[51] Int. Cl.[4] ..... G03G 9/14
[52] U.S. Cl. ..... 430/106.6; 430/403
[58] Field of Search ..... 430/107, 903, 904, 109

[56] References Cited

U.S. PATENT DOCUMENTS

| | | | |
|---|---|---|---|
| 3,166,527 | 1/1965 | Ender | 525/523 |
| 3,185,777 | 5/1965 | Rheinfrouk | 430/107 X |
| 3,252,825 | 5/1966 | Marzocchi | 528/27 X |
| 3,368,893 | 2/1968 | Garrett | 525/523 |
| 3,639,245 | 2/1972 | Nelson | 430/109 |
| 3,938,992 | 2/1976 | Jadwin | 430/107 |
| 4,073,739 | 2/1978 | Peters | 430/109 |
| 4,137,188 | 1/1979 | Vetake et al. | 430/109 |

*Primary Examiner*—John D. Welsh
*Attorney, Agent, or Firm*—Finnegan, Henderson, Farabow, Garrett & Dunner

[57] ABSTRACT

A magnetic toner containing a resin which is obtained by the reaction of a compound containing epoxy radical with an amino-silane compound.

8 Claims, No Drawings

MAGNETIC TONER

This is a continuation of application Ser. No. 944,353, filed 9/21/78, abandoned.

BACKGROUND OF THE INVENTION

The present invention relates to a development material for wide use in the electrophotographic apparatus, electrostatic recording technique etc., and more particularly to a magnetic toner of the single component type for use, say, in the magnetic brush development process.

The conventional developer of the dry process consists of a coloring material called a toner which is mainly composed of synthetic resin and a separate carrier containing iron powder, etc. The development process employing such a development material comprises the frictional electrical charging of toner by the friction between the toner and the carrier and the activity of electrostatic attracting power between said toner and the electric charge of the surface of the drum or recording medium, thereby forming a fixed image on said recording medium and the like. Many processes for transporting the toner and attaching it to the electrostatic latent image are known, such as the cascade development process, fur-brush development process, powder cloud development process, impression development process and magnetic brush development process. The most important problems about such a toner of binary component system are that the toner used repeatedly for a long time is attached to the surface of the carrier, and that the distribution of charge in the toner mass becomes unequal by the pulverization of the carrier particles and other reasons, resulting the degeneration of the quality of image. Furthermore, the carrier must be exchanged and its maintenance is inconvenient.

Recently a processs more convenient than employing a magnetic roll was developed. This process features that the toner particles internally contain magnetic particles, referred to herein as single component toner, thereby dispensing with carrier particles. Furthermore in regard to the fixing process, the thermo setting and pressure setting processes, which are simpler than development using magnetic rolls have come in use. In the processes of thermosetting and pressure-setting, said magnetic toner is transported from its supply vessel by the magnetic power of a magnetic roll to the development zone; and the characteristics required of the magnetic toner in this step include the magnetic characteristics, such as the saturated magnetization $4\pi Is$, coersive force Hc and Curie point Tc, the electric characteristic of being attracted to the electrostatic latent image under the presence of electric charge or electric field and against the magnetic power and fluidity and the setting characteristics discussed below. The magnetic characteristic among these characteristics is substantially defined by the magnetic characteristic of the magnetic material itself and its content.

The requirements of the setting characteristic differ depending on the type of process. In thermosetting process, the requirement is rapid melting and fixing at a predetermined temperature; and in pressure setting process, the requirement is the fixability under extreme low pressure. In order to obtain sharp images without the blackening or coloring of background, all the toner particles should preferably have equal electric charge and particle size.

Examples of the pigments and dyestuffs available as antistatic agent and/or coloring agent include carbon black, nigrosine dyestuffs, aniline blue, chrome yellow, chalco-oil-blue, chinoline yellow, malachite green oxalate, lamp black, robe bengal, methylene blue chloride, DuPont oil red, other azo-compound, metal-containing dyestuffs, organic acid metal salts and the mixtures thereof. Said coloring materials etc., however, present generally very poor miscibility with adhesive resin and require melting and kneading for a long time in order to obtain an evenly distributed mixture. The distribution of the electric charge in toner is often uneven because of the fluctuation of composition. This fact is one reason for the blackening of background.

Furthermore, some of the widely known adhesive resins such as polyethylene, styreneacryl copolymer, polyamide and epoxy-vinyl-styrene, etc., contain functional radicals, and when these kinds of resin are employed to prepare a magnetic toner with excellent fixability and fluidity, the toner particles often coagulate or solidify because of the atmospheric humidity and/or the temperature rise within the facsimile apparatus, so that development may become impossible or fluidity may be lowered or the toner may be altered. In other words, the toner shows a poor preservability (heat resistance, moisture resistance, etc.). Such a degenerative phenomenon occurs particularly in summer and is particularly troublesome for the thermosetting toner which is difficult to preserve a long time. The degeneration of preservability results not only from the above-mentioned reason but also from the mechanical impact due to the mechanical friction with the sleeve covering the small gaps in the doctor plate of the development member and the magentic roll so that the surface layer of the toner and the particles themselves may be broken. These breaks also tend to cause the blackening of background on the electrostatic charge image.

In order to avoid the degeneration of the durability, the heat resistance and mechanical strength of the resin should be enhanced or, in other words, a high-molecular weight containing smaller number of terminal radicals should be used. In this case, however, the setting characteristic is generally degenerated and the pulverization to extreme fineness generally poses a great difficulty in the process of preparing toner.

SUMMARY OF THE INVENTION

It is an object of the present invention to provide improved magnetic toner for electro-photography and electrostatic recording technique.

The present inventors after having tried to remedy the above drawbacks found that the toner containing a resin obtained by the reaction of a compound containing an epoxy radical with a silane compound having a primary or secondary amino radical would be most satisfactory to all the objects of the present invention, thus leading to the success of the present invention.

DETAILED DESCRIPTION OF THE PREFERRED EMBODIMENTS

The reaction product of a resin containing an epoxy radical with a silane compound containing a primary or secondary amino radical according to the present invention has the crosslinking structure because the Si atom contained in the silane compound has the property of forming reticular structure by its electronic arrangement, and accordingly the dispersibility of the magnetic particles and coloring agent is better than that of the conventional toner. Therefore, the obtained toner presents uniform charge distribution and enhances durability without harming the fixability.

In order to form an excellent cross-linkage in an amino-silane compound usable in the present invention, the silane compound should preferably contain at least one primary or secondary amino radical in at least one binding direction about the center of a silicon atom, and the number of carbon and/or silicon atoms in said amino radical should preferably be at least six. One example of particularly preferable amino silane compounds is N-$\beta$-monoalkyl-aminoethyl-$\gamma$-alkyl-aminopropyl- alkyl-dimethoxy-silane:

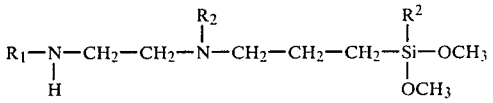

wherein $R_1$, $R_2$ and $R_3$ are independently H or an alkyl radical containing less than 3 carbon atoms.

Examples of the resin containing epoxy radical to react with said silane compound according to the present invention include Epikotes 828, 830, 834, 1001, 1002, 1004 and 1007, etc., of Shell Co. in Netherlands, Araldites 6071, 6084, etc., of Ciba Co. in Switzerland, and the glycidyl esters of epoxy resin, novolak resin or tetrachloro-bisphenol A. Furthermore, the reaction product of the copolymer or homopolymer of glycidyl methacrylate containing epoxy radical may be used as the resinous compound for the toner.

In order to prepare the toner, said powder of epoxy resin and the aminosilane compound of the present invention are mixed and reacted together by heat and fusion or are dissolved into a solvent, heated and stirred. Alternately the coloring agent and magnetic particles mixture are directly mixed with said mixture, and fused and kneaded to obtain the composition for magnetic toner immediately. Said epoxy resin mixed with aminosilane compound can be used individually as resin for the toner. Especially when the composition for use in magnetic toner should be directly prepared, the addition quantity of aminosilane compound may be adjusted to obtain desirable durability and fixability. On the other hand, in order to control the softening temperature and mechanical strength, said epoxy resin mixed with aminosilane compound also may be conveniently added with other miscible resin. The mixing rate may vary depending on the polymerization degree of the treated epoxy resin mixed with aminosilane compound, but should generally be at least 5% by weight and preferably at least 10% by weight of the total quantity of resin. Examples of the desirable resin to be mixed to the resin of the present invention include polystyrene, styrene-acryl copolymer, epoxy resin, vinyl naphthalene vinyl styrene, $\alpha$-methylene-aliphatic monocarboxylic acid ester, acrylonitrile, methacrylonitrile, acryl-amide, vinyl ether, vinyl ketone, N-vinyl-compound polymer or copolymer, and nonvinyl thermoplastic resin. The resin excellent in miscibility among said compounds is epoxy resin.

The present invention is elucidated by the following typical examples which will not be construed to limit the scope of the present invention.

EXAMPLE 1

Epikote 1002: 45% by weight
Magnetite: 50% by weight
Carbon black: 5% by weight

One kilogram of the composition of these components is mixed with 0.02 to 3.5% by weight of N-$\beta$-aminoethyl-$\gamma$-aminopropyl-methyl-dimethoxy-silane on the base of said composition and is kneaded at 80°–150° C. for 30–120 min. with a pair of heated rolls. The kneaded mass after cooling is crushed with a jaw crusher and pulverized with a jet mill to obtain an average particle diameter of 22 $\mu$m. Then a mass of carbon black of 3 weight % is mixed into said mixture in the mixer and then treated thermally for a short time at 100° to 260° C. to obtain a magnetic toner for thermosetting. Table 1 shows the data of said toner such as conductivity $\sigma$, fluidity calculated from the angle of repose $\theta$, fixability, relative humidity, durable time required till coagulation of the toner occurs under a relative humidity of 40% at 50° C., and the image characteristic of image measured according to the method mentioned in U.S. Pat. No. 3,639,245 (approval date: Feb. 1, 1972).

TABLE 1

| Sample No. | Addition quantity of silane* | mho/cm | Angle of repose $\theta$ (degree) | Setting condition (in an oven) °C. | sec | Durable time at 50° C. & RH 40% | Quality of image |
|---|---|---|---|---|---|---|---|
| 1 | 0 | $2 \times 10^{-4}$ | 36 | 130 | 3 | 10 min. | Blackening of background |
| 2 | 0.02 | $2 \times 10^{-4}$ | 35 | 130 | 3 | 30 min. | Blackening of background |
| 3 | 0.05 | $2 \times 10^{-4}$ | 34 | 130 | 3 | 1 h | Slight blackening of B.G. |
| 4 | 0.1 | $3 \times 10^{-4}$ | 33 | 130 | 3 | 10 h | No blackening of background |
| 5 | 0.2 | $3 \times 10^{-4}$ | 33 | 130 | 3 | 100 h | No blackening of background |
| 6 | 0.4 | $3 \times 10^{-4}$ | 33 | 130 | 4 | 300 h | No blackening of background |
| 7 | 0.7 | $4 \times 10^{-4}$ | 32 | 130 | 4 | 500 h | No blackening of background |
| 8 | 1.0 | $4 \times 10^{-4}$ | 32 | 130 | 5 | 1000 h | No blackening of |

TABLE 1-continued

| Sample No. | Addition quantity of silane* | mho/cm | Angle of repose θ (degree) | Setting condition (in an oven) °C. | sec | Durable time at 50° C. & RH 40% | Quality of image |
|---|---|---|---|---|---|---|---|
| | | | | | | | background |
| 9 | 1.2 | $4 \times 10^{-4}$ | 32 | 130 | 5 | 1500 h | No blackening of background |
| 10 | 1.5 | $5 \times 10^{-4}$ | 31 | 130 | 7 | 2000 h | No blackening of background |
| 11 | 2.0 | $6 \times 10^{-4}$ | 31 | 130 | 10 | >2000 h | No blackening of background |
| 12 | 2.5 | $6 \times 10^{-4}$ | 31 | 130 | 15 | >2000 h | No blackening of background |
| 13 | 3.0 | $7 \times 10^{-4}$ | 30 | 130 | 20 | >2000 h | No blackening of background |
| 14 | 3.5 | $7 \times 10^{-4}$ | 30 | 130 | 50 | >2000 h | No blackening of background |

*Silane: N—β-aminoethyl-γ-aminopropyl-methyl.dimethoxy-silane.

Images thus formed were recorded on the electrostatic copying sheets 21 MH (made by Kanzaki Paper Co.) by the electrostatic latent image transferring process (TESI System). It will be evidently understood from Table 1 that the magnetic toner containing at least 0.1% by weight of aminosilane compound presents remarkable durability. On the other hand, the fixability does not fluctuate so much at less than 1.2% of the addition quantity of silane.

When the toner of the present invention was employed for a line printer and a facsimile available on the market, it was found that the additional quantities of silane of 1.0–3.0% by weight and 0.2–1.2% by weight of the toner for the line printer and the facsimile respectively presented optimum fixability and image quality with excellent image concentration free of the blackening of background. The optimum fluidity of the magnetic toner was obtained for the angle of repose θ within a range of 32°±2°. This condition was satisfactory for the toners of Sample No. 3 and higher in Table 1. In these cases, the same high quality of images was maintained from the initial copy to about 15,000th copy.

When N-βmethylaminoethyl-γ-aminopropyl-methyl. dimethoxy silane was employed as the aminosilane compound to take place of the said compound, an excellent magnetic toner with the characteristic similar to those found in Table 1 was obtained.

EXAMPLE 2

After 98% by weight of Araldite 6071 and 2% by weight of N-β-ethylamino-ethyl-γ-aminopropyl methyl-dimethoxy silane have been mixed and pulverized, they are caused to for 10 to 150 minutes at 100° to 170° C. in a reactor to form resin.

Subsequently, 40% by weight of the resultant product, 20% by weight of Epikote 1004, 10% by weight of carbon black, and 30% by weight of iron powder are introduced into acetone and pulverized to disperse 24 hours in a ball mill. The resultant emulsion is sprayed to dry with a spray-drier of laboratory type to obtain a thermosetting magnetic toner for use in PPC, which can form a sharp image with an average particle size of 22 μm, $\sigma = 3 \times 10^{-11}$ mho/cm and θ=34%. The durability of the toner obtained was 1000 hours at 50° C. and 40% RH. A PPC image is formed by conventional electrophotography. The formed electrostatic latent image on a photosensitive sheet of ZnO type is developed with the above toner and, after providing this image surface with the corona electric charge of −6 KV, the sheet is overlaid with a duplication sheet and subjected to the corona duplication process at +6 KV. Excellent fixability is also obtained.

It will be understood from the above examples that the magnetic toner of the present invention presents excellent fluidity, fixability and durability for use in PPC and CPC. When a production facility of larger dimensions is employed, its mass production will be possible inexpensively and conveniently. The toner of the present invention will enjoy a great industrial value.

What we claim is:

1. A magnetic toner of the single component type comprising magnetic particles and a resin, wherein said resin comprises at least 5% by weight based on the total weight of resin, of epoxy resin cross-linked with about 0.2 to 7.2% by weight, based on the weight of the epoxy resin, of a primary or secondary aminosilane.

2. A magnetic toner according to claim 4 in which the aminosilane compound is represented by the formula:

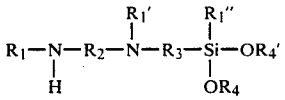

wherein $R_1$, $R_1'$, $R_1''$, $R_4$ and $R_4'$ are independently H or an alkyl radical containing less than 3 carbon atoms, and $R_2$ and $R_3$ are independently a radical comprised of hydrocarbon containing a saturated or double bond and having 1 to 6 carbon atoms.

3. A magnetic toner according to claim 1 wherein the aminosilane has the formula:

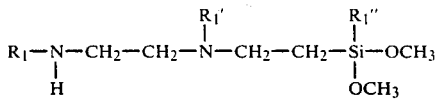

where $R_1$, $R_1'$, and $R_1''$, are independently H or an alkyl radical containing less than 3 carbon atoms.

4. A magnetic toner of the single component type comprising magnetic particles and a resin, wherein said resin comprises at least 5% by weight based on the total weight of resin, of epoxy resin cross-linked with 0.2 to 7.2% by weight, based on the weight of the epoxy resin, of am aminosilane selected from the group consisting of N-β-aminoethyl-γ-aminopropyl methyl-dimethoxysilane, N-β-methylaminoethyl-γ-aminopropyl methyl-dimethoxysilane, N-β-ethylaminoethyl-γ-aminopropyl methyl-dimethoxysilane.

5. A magnetic toner according to claims 1 or 4 wherein the magnetic particles comprise particles of magnetite.

6. A magnetic toner according to claims 1 or 4 wherein the magnetic particles comprise particles of iron.

7. A magnetic toner according to claims 1 or 4 further comprising a pigment or dyestuff.

8. A magnetic toner according to claims 1 or 4 further comprising black carbon.

* * * * *